US009011302B2

(12) United States Patent
Lalaoua

(10) Patent No.: US 9,011,302 B2
(45) Date of Patent: Apr. 21, 2015

(54) THIGH EXERCISE DEVICE

(75) Inventor: Nabile Lalaoua, Las Vegas, NV (US)

(73) Assignee: Telebrands Corp., Fairfield, NJ (US)

( * ) Notice: Subject to any disclaimer, the term of this patent is extended or adjusted under 35 U.S.C. 154(b) by 274 days.

(21) Appl. No.: 13/343,895

(22) Filed: Jan. 5, 2012

(65) Prior Publication Data

US 2013/0178343 A1 Jul. 11, 2013

(51) Int. Cl.

| | |
|---|---|
| ***A63B 22/00*** | (2006.01) |
| ***A63B 21/018*** | (2006.01) |
| ***A63B 21/04*** | (2006.01) |
| ***A63B 21/00*** | (2006.01) |
| ***A63B 22/20*** | (2006.01) |
| ***A63B 23/04*** | (2006.01) |

(52) U.S. Cl.

CPC ..... *A63B 21/0414* (2013.01); *A63B 21/1465* (2013.01); *A63B 22/203* (2013.01); *A63B 23/04* (2013.01); *A63B 2022/206* (2013.01); *A63B 2210/50* (2013.01)

(58) Field of Classification Search

USPC ..... 482/121–124, 70–71, 51, 54, 79–80, 482/52, 92, 129–130, 133, 135–137

See application file for complete search history.

(56) References Cited

U.S. PATENT DOCUMENTS

| | | | | |
|---|---|---|---|---|
| 6,117,056 | A * | 9/2000 | Cataldi et al. | 482/121 |
| 6,837,838 | B2 * | 1/2005 | List | 482/147 |
| 7,780,585 | B1 * | 8/2010 | Rivas | 482/140 |
| 7,803,091 | B2 * | 9/2010 | Loane | 482/70 |
| D626,186 | S * | 10/2010 | Tsai | D21/668 |
| 7,892,152 | B1 * | 2/2011 | Teng | 482/79 |
| 7,981,005 | B1 * | 7/2011 | Tsai | 482/51 |
| 2004/0053752 | A1 * | 3/2004 | Yang | 482/70 |
| 2010/0190621 | A1 * | 7/2010 | Palmer | 482/121 |
| 2014/0309091 | A1 * | 10/2014 | Tang et al. | 482/130 |

OTHER PUBLICATIONS

Parker O-Ring Handbook, ORD 5700, 2007.*

* cited by examiner

*Primary Examiner* — Loan H Thanh
*Assistant Examiner* — Megan Anderson
(74) *Attorney, Agent, or Firm* — Cooper & Dunham LLP

(57) ABSTRACT

A thigh exercise device includes a curved track, two foot pedal assemblies movably attached to the curved track and respectively having a guide pulley, and two resistance assemblies each having two pulleys rotatably mounted on the curved track and a resistance band wound around the pulleys and the guide pulley of one of the foot pedal assemblies. When the foot pedal assemblies are moved along the curved track, the resistance bands can be pulled tight by the guide members of the foot pedal assemblies such that a user can strengthen thigh muscles through the tension provided by the resistance bands.

7 Claims, 7 Drawing Sheets

THIGH EXERCISE DEVICE

BACKGROUND OF THE INVENTION

1. Field of the Invention

The present invention relates generally to a thigh exercise device, and more specifically to a thigh exercise device having a simple structure to perform thigh muscles work.

2. Description of the Related Art

Many exercise devices in the prior art have combined in one apparatus to strengthen several different muscle groups, including upper and lower body muscles. However, the lower body muscles, which are strengthened in these devices, are usually the quadricep or calf muscles of the leg; and further, these exercise devices are generally heavy and inconvenient for storage. Therefore, it is a need to provide an improved exercise device that can strengthen the thigh muscles and eliminate the aforesaid drawbacks.

SUMMARY OF THE INVENTION

It is one objective of the present invention to provide a thigh exercise device, which has a simple structure.

It is another objective of the present invention to provide a thigh exercise device, which is foldable for easy storage.

To achieve these objectives of the present invention, the thigh exercise device provided by the present invention comprises a curved track, a pair of resistance assemblies respectively having two pulleys rotatably mounted on the curved track and a resistance band wound around the pulleys, and a pair of foot pedal assemblies movably attached to the curved track and respectively having a guide pulley located in each of the resistance bands. By means of this design, when a user sits on a chair and places both feet on the foot pedals to move the foot pedal assemblies along the curved track, the resistance bands can be pulled tight by the guide pulleys of the foot pedal assemblies to perform thigh muscles work.

Furthermore, the curved track can include a holder, a handle connected with a top side of the holder, and two frames pivotally connected with two opposite sides of the holder, such that the curved track can be foldable for storage through the pivotal movement of the frames relative to the holder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
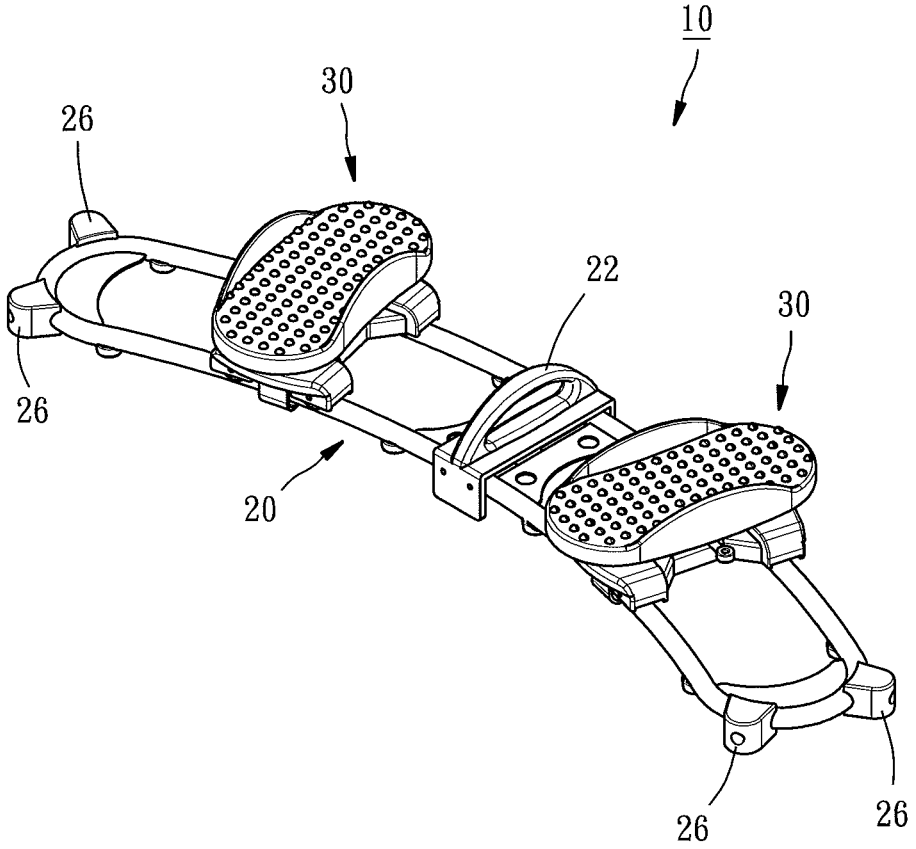
FIG. 1 is a perspective view of a thigh exercise device according to a preferred embodiment of the prevent invention.
Figure 2:
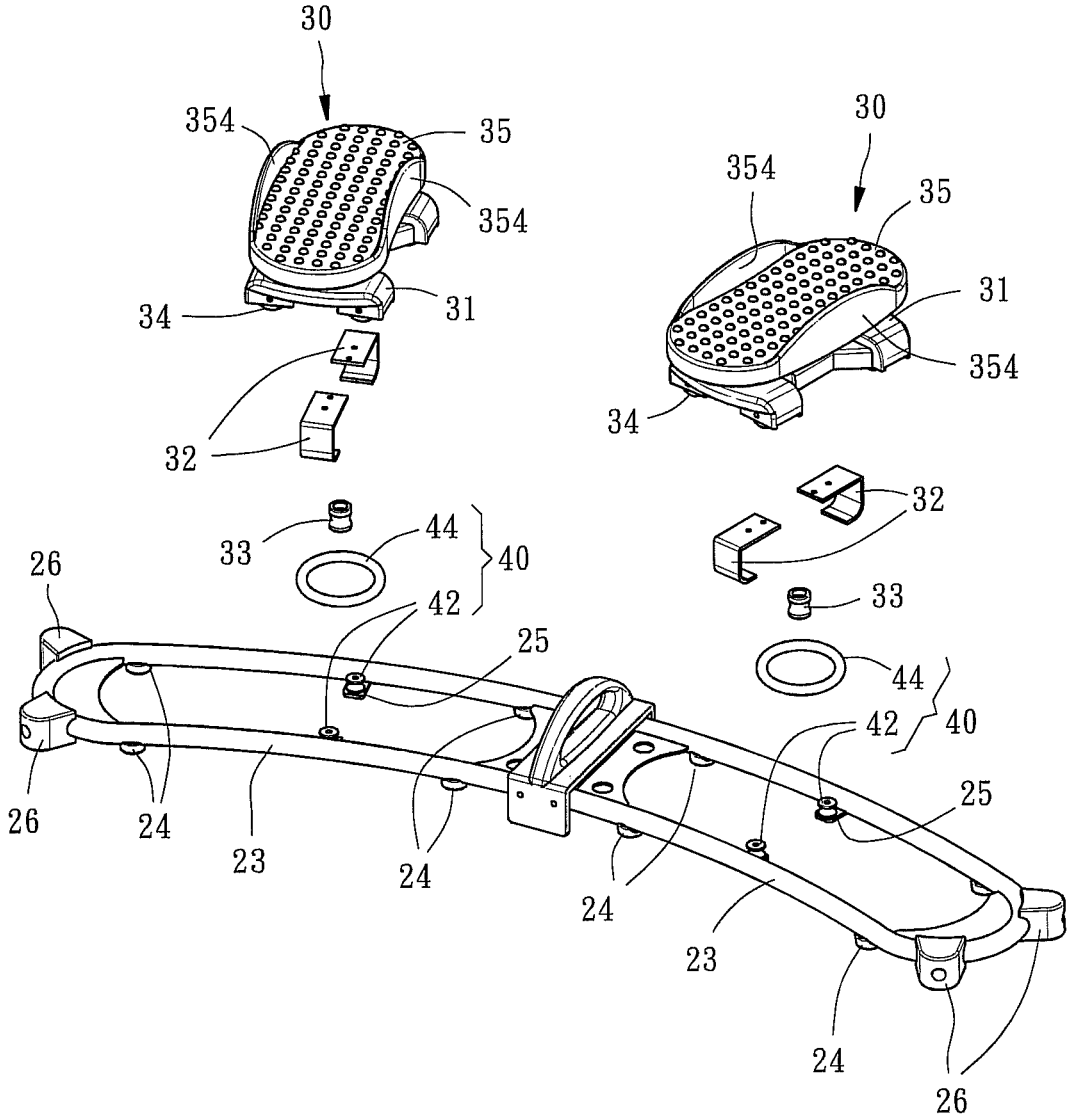
FIG. 2 is an exploded view of the thigh exercise device according to the preferred embodiment of the prevent invention.

As shown in FIGS. 1 to 2, a thigh exercise device 10 in accordance with a preferred embodiment of the present invention comprises a curved track 20, a pair of foot pedal assemblies 30, and a pair of resistance assemblies 40.

The curved track 20 includes a holder 21, a handle 22 connected with a top side of the holder 21, two frames 23 pivotally connected with two opposite sides of the holder 21, and four pairs of non-slip pads 24 mounted on bottom sides of the frames 23 and located at two opposite ends of each of the frames 23. Two support blocks 26 are mounted at two opposite ends of the curved track 20 for supporting the curved track 20.

Figure 3:
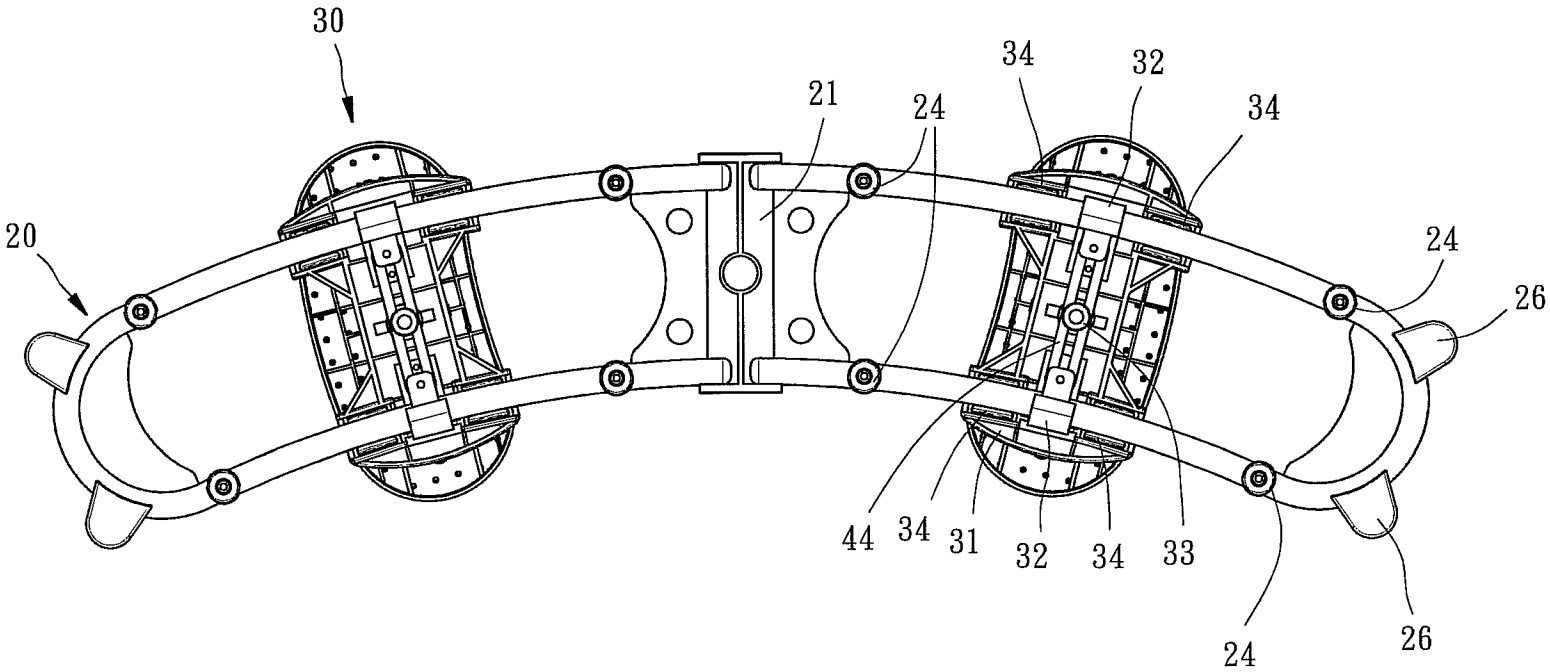
FIG. 3 is a bottom view of the thigh exercise device according to the preferred embodiment of the prevent invention.
Figure 5:
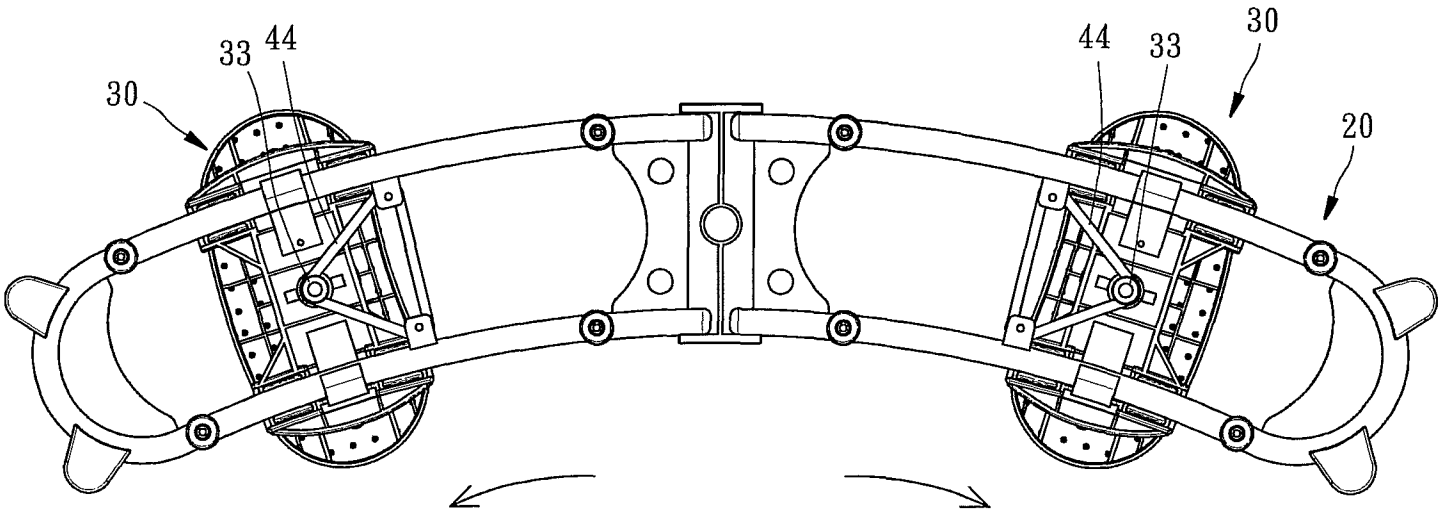
FIG. 5 is similar to FIG. 4, but showing the foot pedal assemblies are moved outwards along the curved track.

As shown in FIGS. 2, 3, and 5, each of the foot pedal assemblies 30 includes a support base 31 supported on one of the frames 23, two fasteners 32 fastened to a bottom side of the support base 31 for clamping the curved track 20 therebetween, a guide pulley 33 rotatably mounted with the bottom side of the support base 31, a plurality of wheels 34 rotatably mounted on the bottom side of the support base 31 and engaged with the curved track 20, and a foot pedal 35 pivotally mounted on a top side of the support base 31 through a pivot 352 such that the foot pedal 35 can be moved up and down like a seesaw, and provided with two retaining walls 354 at two opposite sides thereof for preventing a user's foot from slipping off the foot pedal 35. By this way, the foot pedal assembly 30 can be forced to move along the curved track 20 through the rotation of the wheels 34, and it can be stopped from moving when the fasteners 32 are stopped against one pair of the non-slip pads 24.

Each of the resistance assemblies 40 includes two pulleys 42 rotatably mounted on the curved track 20 through a lug 25 protruding from an inner side of the curved track 20, and an o-ring resistance band 44, which is embodied as a solid elastomer ring with a circular cross-section, wound around the pulleys 42. The guide pulley 33 of one of the foot pedal assemblies 30 is located in each of o-ring resistance bands 44 such that the o-ring resistance bands 44 can be pulled into tension by the guide pulleys 33 of the foot pedal assemblies 30 during the movement of the foot pedal assemblies 30, as shown in FIGS. 3 to 5; and further, the foot pedal assemblies 30 can be moved smoothly through the cooperation of the guide pulleys 33 and the pulleys 42 of the resistance assemblies 40.

The structure of the thigh exercise device 10 is described as above, and the operation of the thigh exercise device 10 of the present invention is outlined hereinafter.

Figure 4:
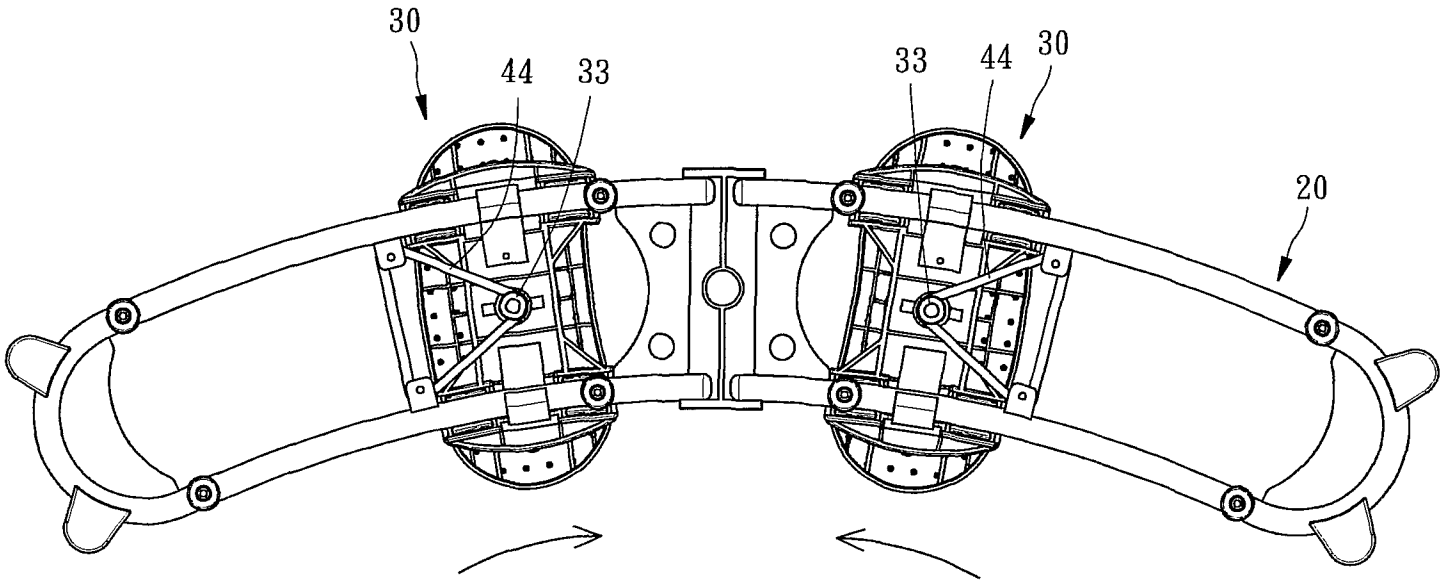
FIG. 4 is a bottom view of the thigh exercise device according to the preferred embodiment of the prevent invention, showing the foot pedal assemblies are moved inwards along the curved track.
Figure 6:
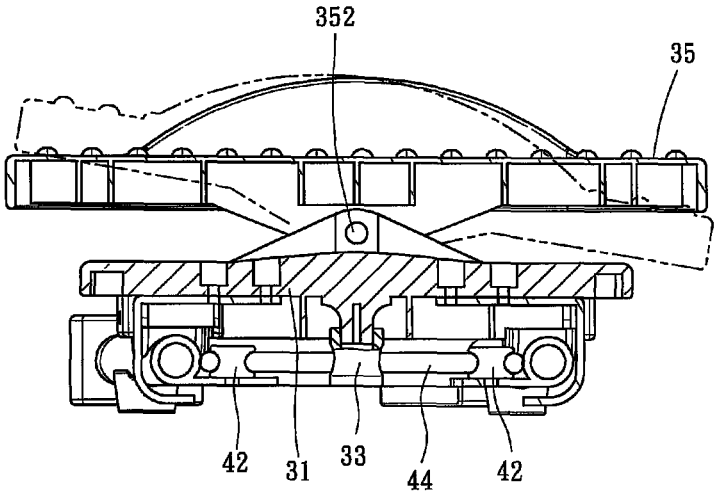
FIG. 6 is a partial sectional view of the thigh exercise device according to the preferred embodiment of the prevent invention, showing the foot pedal is pivotable relative to the support base.

When sitting on a chair and placing both feet on the foot pedals 35, the user can laterally move both feet inwards and outwards such that the foot pedal assemblies 30 can be driven to move along the curved track 20 leftwards and rightwards, and meanwhile the o-ring resistance bands 44 can be drawn tight by the movement of the foot pedal assemblies 30 through the guide pulleys 33, as shown in FIGS. 4 and 5. In this way, the user can strengthen thigh muscles by means of the tension generated in the o-ring resistance bands 44, and the o-ring resistance bands 44 can be removed easily from the pulleys 42 and changeable with other bands to select different tension from hard, medium and light bands. Besides, the user can force the foot pedals 35 to be tilted in multiple angle positions to target the hips, buns, thighs and calves muscle, as shown FIG. 6.

Figure 7:
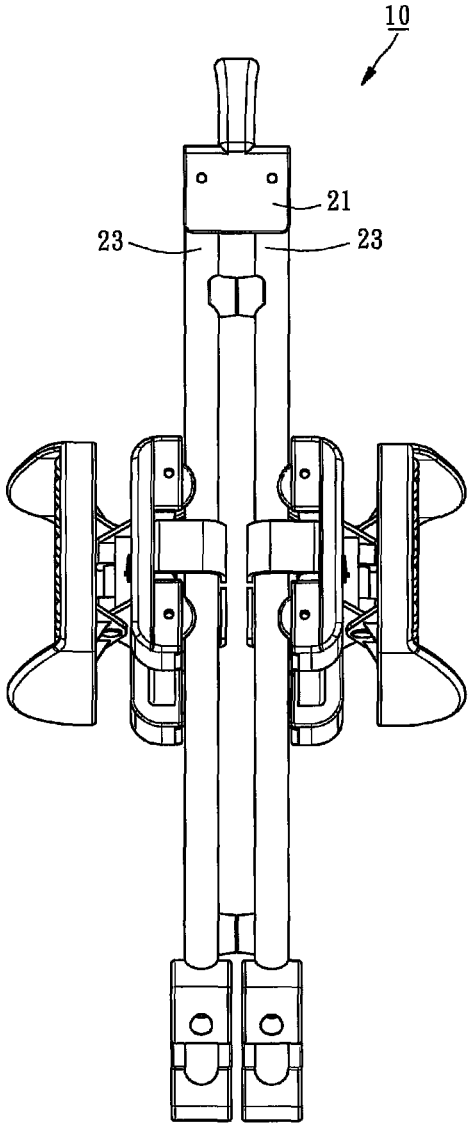
FIG. 7 is a front view of the thigh exercise device according to the preferred embodiment of the prevent invention, showing the thigh exercise device is folded.

When the operation of the thigh exercise device 10 is completed, the user can hold the handle 22 and then lift up the thigh exercise device 10 from the ground to allow the thigh exercise device 10 to be folded through the pivotal movement of the frames 23 relative to the holder 21, as shown in FIG. 7. After folded, the thigh exercise device 10 is easy to be stored and carried anywhere.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thigh exercise device comprising:

a curved track;

a pair of resistance assemblies each having two pulleys rotatably mounted on the curved track and an O-ring resistance band wound around the two pulleys; and a pair of foot pedal assemblies movably attached to the curved track, and respectively having a guide pulley, wherein each of the guide pulleys are located within the respective O-ring resistance band such that the O-ring resistance band is pulled into tension by the guide pulley during movement of the respective foot pedal assembly.

2. The thigh exercise device as claimed in claim 1, wherein the curved track includes a holder, a handle connected with a top side of the holder, and two frames pivotally connected with two opposite sides of the holder.

3. The thigh exercise device as claimed in claim 1, wherein each of the foot pedal assemblies includes a support base supported on the curved track, two fasteners fastened to a bottom side of the support base for clamping the curved track therebetween, a plurality of wheels rotatably mounted on the bottom side of the support base and engaged with the curved track, and a foot pedal pivotally mounted on a top side of the support base.

4. The thigh exercise device as claimed in claim 3, wherein each of the fasteners is stoppable against a pad mounted on a bottom side of the curved track for stopping the foot pedal assembly from moving.

5. The thigh exercise device as claimed in claim 3, wherein each of the foot pedals has two retaining walls at two opposite sides thereof.

6. The thigh exercise device as claimed in claim 1, wherein the curved track has two support blocks at two opposite ends thereof.

7. The thigh exercise device as claimed in claim 1, wherein the O-ring resistance band is a solid elastomer ring with a circular cross-section.

* * * * *